US011236278B2

(12) United States Patent
Wünning et al.

(10) Patent No.: US 11,236,278 B2
(45) Date of Patent: Feb. 1, 2022

(54) PROCESS FOR GASIFYING BIOMASS WITH TAR ADSORPTION

(71) Applicant: WS-Wärmeprozesstechnik GmbH, Renningen (DE)

(72) Inventors: Joachim G. Wünning, Leonberg (DE); Joachim A. Wünning, Leonberg (DE)

(73) Assignee: WS-Wärmeprozesstechnik GmbH, Leonberg (DE)

( * ) Notice: Subject to any disclaimer, the term of this patent is extended or adjusted under 35 U.S.C. 154(b) by 275 days.

(21) Appl. No.: 16/340,954

(22) PCT Filed: Oct. 10, 2017

(86) PCT No.: PCT/EP2017/075813
§ 371 (c)(1),
(2) Date: Apr. 10, 2019

(87) PCT Pub. No.: WO2018/069320
PCT Pub. Date: Apr. 19, 2018

(65) Prior Publication Data

US 2019/0233750 A1 Aug. 1, 2019

(30) Foreign Application Priority Data

Oct. 12, 2016 (EP) ..... 16193586

(51) Int. Cl.
*C10J 3/62* (2006.01)
*C10J 3/00* (2006.01)
(Continued)

(52) U.S. Cl.
CPC ..... *C10J 3/62* (2013.01); *C10J 3/007* (2013.01); *C10J 3/66* (2013.01); *C10K 1/32* (2013.01);
(Continued)

(58) Field of Classification Search
CPC ..... C10J 2300/0916; C10J 3/66; C10J 3/721; C10J 2300/1884; C10J 2300/1207; C10J 3/64; C10J 3/62
See application file for complete search history.

(56) References Cited

U.S. PATENT DOCUMENTS 6,911,058 B2 6/2005 Calderon et al.
6,960,234 B2 11/2005 Hassett
(Continued)

FOREIGN PATENT DOCUMENTS

CN 1483068 A 3/2004
CN 1551911 A 12/2004
(Continued)

OTHER PUBLICATIONS

International Search Report and Written Opinion dated Dec. 20, 2017, for International Application No. PCT/EP2017/075813 (11 pages).
(Continued)

*Primary Examiner* — Imran Akram
(74) *Attorney, Agent, or Firm* — Fitch, Even, Tabin & Flannery LLP

(57) ABSTRACT

A process and apparatus for gasification of biomass. Biogenic residue may be supplied to a heating zone to dry the biomass and allow the volatile constituents to escape to generate a pyrolysis gas. The pyrolysis gas is supplied to an oxidation zone and substoichiometrically oxidized to generate a crude gas. The carbonaceous residue generated in the heating zone and the crude gas is partially gasified in a gasification zone. The gasification forms activated carbon and a hot process gas. The activated carbon and the hot process gas are conjointly cooled. The adsorption process during the conjoined cooling has the result that tar from the hot process gas is absorbed on the activated carbon in the cooling zone. A pure gas which is substantially tar-free is
(Continued)

obtained. The tar-enriched activated carbon may be at least partly burned for heating the heating zone and/or the gasification zone.

11 Claims, 3 Drawing Sheets

(51) Int. Cl.
*C10K 1/32* (2006.01)
*C10J 3/66* (2006.01)

(52) U.S. Cl.
CPC .. *C10J 2200/158* (2013.01); *C10J 2300/0909* (2013.01); *C10J 2300/0916* (2013.01); *C10J 2300/0956* (2013.01); *C10J 2300/1207* (2013.01); *C10J 2300/1625* (2013.01)

(56) References Cited

U.S. PATENT DOCUMENTS

| | | | | |
|---|---|---|---|---|
| 8,100,991 | B2 | 1/2012 | Sasauchi et al. | |
| 8,252,072 | B2 | 8/2012 | Galip et al. | |
| 8,783,036 | B2 | 7/2014 | Corry et al. | |
| 9,422,491 | B2 | 8/2016 | Schwarz et al. | |
| 10,011,792 | B2 | 7/2018 | Patel | |
| 2002/0095866 | A1* | 7/2002 | Hassett | C01B 3/36 48/199 FM |
| 2003/0005634 | A1 | 1/2003 | Calderon et al. | |
| 2008/0317657 | A1* | 12/2008 | Hall | C10J 3/00 423/437.1 |
| 2009/0260286 | A1 | 10/2009 | Sasauchi et al. | |
| 2011/0078951 | A1 | 4/2011 | Blasiak et al. | |
| 2012/0036777 | A1 | 2/2012 | Patel | |
| 2013/0168317 | A1* | 7/2013 | Vanderbeken | C02F 1/385 210/663 |
| 2016/0304345 | A1* | 10/2016 | Li | C10J 3/58 |

FOREIGN PATENT DOCUMENTS

| | | | |
|---|---|---|---|
| CN | 101346455 | A | 1/2009 |
| CN | 201678647 | U | 12/2010 |
| CN | 102559278 | A | 7/2012 |
| CN | 202610180 | U | 12/2012 |
| CN | 103154210 | A | 6/2013 |
| CN | 103619997 | A | 3/2014 |
| CN | 203462013 | U | 3/2014 |
| DE | 19846805 | A1 | 4/2000 |
| DE | 202009008671 | U1 | 10/2009 |
| DE | 102008043131 | A1 | 4/2010 |
| EA | 9349 | B1 | 12/2007 |
| EA | 17739 | B1 | 2/2013 |
| EP | 1348011 | A1 | 10/2003 |
| EP | 1436364 | B1 | 6/2010 |
| EP | 2522707 | A2 | 11/2012 |
| EP | 2636720 | A1 | 9/2013 |
| JP | 2000-505123 | A | 4/2000 |
| JP | 2004-534903 | A | 11/2004 |
| JP | 2007-177106 | A | 7/2007 |
| RU | 2124547 | C1 | 1/1999 |
| RU | 2287010 | C2 | 11/2006 |
| WO | 02/46331 | A1 | 6/2002 |
| WO | 03/006585 | A1 | 1/2003 |

OTHER PUBLICATIONS

European Search Report dated Mar. 23, 2017, for European Application No. 16193586.1 (4 pages).

Chinese First Office Action dated Sep. 27, 2020, in corresponding Chinese Application No. 201780062963.6, with English translation (25 pages).

Russian Office Action and Search Report dated Nov. 11, 2020, in corresponding Russian Application No. 2019113507/05(026183), with machine English translation (14 pages).

Indian Office Action dated Nov. 24, 2020, in corresponding Indian Application No. 201917018580 (5 pages).

Ukranian Office Action dated Jan. 28, 2021, in corresponding Ukranian Application No. a201904917, with English translation (10 pages).

Japanese Office Action dated Sep. 24, 2021, in corresponding Japanese Application No. 2019-519717, with English translation (10 pages).

* cited by examiner

PROCESS FOR GASIFYING BIOMASS WITH TAR ADSORPTION

CROSS REFERENCE TO RELATED APPLICATIONS

This patent application is the national phase of PCT/EP2017/075813, filed Oct. 10, 2017, which claims the benefit of European Patent Application No. 16193586.1, filed Oct. 12, 2016.

TECHNICAL FIELD

The invention relates to a process as well as to an apparatus for gasifying biomass. Biomass is understood to mean any carbon-containing biogenic mass such as, for example, wood wastes, crop wastes, grass clippings, fermentation residues, sewage sludge or the like.

BACKGROUND

In practical applications, predominantly decentralized small plants featuring a flow rate of below 200 Kg biomass per hour are used, for example on farms or in communal areas, in order to avoid the transport of biomass and residual substances and be able to utilize the waste heat on site. To this day such plants are not accepted on the market. One substantial reason for this is the tar that is formed during the pyrolysis and gasification of biomass. Until now, tar has had to be removed in an expensive manner and, as a rule, this requires great expenses for the maintenance of such plants. If the gas formed during gasification is to be subsequently used in a cogeneration plant, it is even necessary that the tar be completely removed from the generated product gas. Both the maintenance and also the acquisition of such plants has been expensive so far.

A process and an apparatus for gasifying biomass with the use of a co-current gasification system has been known from publication DE 10 2008 043 131 A1. In order to avoid tar loading of the product gas, the latter suggests a one-step process with the use of the co-current gasification system, in which case fuel is supplied to the gasification chamber against the force of gravity. A stationary fluidized bed is formed in the reduction zone above the oxidation zone. As a result of this, the critical channel formation in the region of the reduction zones known from fixed-bed gasifiers should be avoided and, in this manner, tar loading of the product gas should be reduced. However, the generation of such a fluidized bed requires the restriction of the gasification to certain biogenic residual materials and particle sizes, respectively, because otherwise a stable fluidized bed cannot be achieved.

Publication EP 1 436 364 B1 describes an apparatus comprising a reaction chamber wherein biomass is supplied laterally. The gases containing the tar are able to condense on the closed cover in the reaction chamber. This allows either the removal of the condensed tar from the reaction chamber or the return of the tar into the reaction zones inside the reduction chamber. As a result of this, the total degree of efficacy is to be increased. A similar arrangement is also described by publication EP 2 522 707 A2. In that case, there exists an additional post-treatment unit with which the residual material is to be mineralized as completely as possible and "white ash" is to be generated.

Publication DE 20 2009 008 671 U1 describes another solution for biomass gasification. This publication suggests a co-current gasifier comprising a pyrolysis chamber and a gasifier. The tar-containing pyrolysis gas is incinerated at 1200° C. in the oxidation zone of the gasifier. Accordingly, extremely high temperatures are needed in the oxidation zone.

Publication EP 2 636 720 A1 describes a process, wherein a synthesis gas is produced from biomass due steam reformation. This requires extremely large heating surfaces for indirect heating. A fluidized bed is to be generated by means of moving paddles in the gasifier pipes or gasifier coils. The synthesis gas is subsequently cleaned in a counter-current process in a carbon filter and, in so doing, also cools off.

Publication DE 198 46 805 A1 describes a process and an apparatus for the gasification and combustion of biomass. In this process, pyrolysis gas and coke are formed, wherein the coke is conveyed into a gasification reactor in which the coke is partially gasified while activated carbon is formed. The activated carbon is removed from the combustion chamber via a conveyor system and transported into a filter outside the combustion chamber. The product gas formed during the process is removed separately from the activated carbon out of the gasification reactor and cooled in a heat exchanger. Subsequently, the cooled product gas is conducted through the filter that is loaded with activated carbon. In so doing, all harmful substances are to remain in the activated carbon.

Considering this prior art, it may be viewed to be the object of the present invention to provide a process and an apparatus for gasifying biomass, wherein the most diverse biogenic residues are processed independent of particle size, and a low-tar product gas can be produced in an economical manner.

SUMMARY

This object is achieved with a process, as well as by an apparatus displaying the features described herein.

Considering the process according to the invention, the product gas is produced from the biomass that is supplied to an apparatus for gasifying biomass, for example in accordance with Patent Claim 13, in at least three process steps. In a first process step, a crude gas and a carbonaceous residue is generated from the supplied biomass.

To do so, the biomass is oxidized substoichiometrically, for example in an oxidation zone, by supplying oxygen-containing gas, in particular air. The oxygen-containing gas that is to be supplied may be preheated for this. During the substoichiometric oxidation, the crude gas and a coke-like, carbonaceous residue are obtained.

Referring to a modification of the process, biomass supplied during the first process step is heated in a first partial step in a heating zone and/or heated in such a manner that the volatile constituents can escape from the biomass, in which case a pyrolysis gas and the carbonaceous residue are formed. Drying and pyrolysis can be carried out in a shared heating zone. Alternatively, the drying of the biomass and the pyrolysis may be performed in zones that are separate from each other. In a second partial step the pyrolysis gas from the first process step is substoichiometrically oxidized in an oxidation zone due to the supply of oxygen-containing gas, thereby producing the crude gas.

During the process according to the invention the carbonaceous residue and the crude gas from the first process step are partially gasified in a second process step in such a manner that activated carbon is formed. In so doing, preferably up to a maximum of 75% and, further preferably, up to a maximum of 60% to 65% of the carbonaceous residue is gasified in the gasification zone. In one exemplary embodiment, the temperature in the gasification zone may be at a minimum of 800° C. and at a maximum of 1000° C. A hot product gas and activated carbon are formed in the gasification zone.

In the third process step, the hot product gas and at least a part of the activated carbon are cooled together in a cooling zone. In so doing, an adsorption process takes place, in the course of which the tar from the hot product gas is adsorbed on the activated carbon. Consequently, the tar is removed from the hot product gas, and the product gas provided following the third process step is low in tar or substantially free of tar constituents. In the process according to the invention, a certain amount of the activated carbon that is generated in the gasification zone and the hot product gas that are a result of the supplied biomass, are conveyed to the cooling zone and cooled together in the cooling zone, so that an adsorption process takes place during cooling, during which process the specific amount of activated carbon is enriched with tar from the hot product gas while being cooled.

The certain amount of activated carbon has a mass mAK2 from a minimum of 2% to a maximum of 10% of the mass mBwaf of the supplied biomass, referred to the reference condition free of water and free of ash (waf). For example, per one kilogram of supplied biomass with reference to the reference condition, water-free and ash-free, 0.05 kilogram of activated carbon are conveyed into the cooling zone for cooling with the occurring product gas. For example, if a mass flow of biomass mBroh is supplied to the apparatus, the biomass, as a rule, contains water and mineral substances. The mass flow mBroh of supplied biomass thus corresponds to a mass flow mBWaf of biomass in the reference condition, without water and without ash, that, as a rule, is smaller than the mass flow mBroh. If a biomass is supplied at a constant mass flow, a certain mass flow mAK2 of activated carbon is conveyed out of the gasification zone into the cooling zone, in which case the determined mass flow mAK2 is at a minimum of 2% and at a maximum of 10% of the mass flow mBwaf of the biomass, with respect to the reference condition, free of water and free of ash:

$$mAK2=0.02 \ldots 0.1\ mBwaf.$$

In order to achieve that only a certain amount of activated carbon, together with the product gas, is supplied to the cooling zone and cooled there together with the product gas, the process for gasifying biomass can be controlled or regulated, for example, in such a manner that only the certain amount of activated carbon is generated in the gasification zone. Alternatively or additionally, excess activated carbon can be branched off the gasification zone and/or between the gasification zone and the cooling zone.

In the event of a change of demand for pure product gas, for example in the course of a load change of a motor fed therewith, the time delay with which an increase or decrease of the supply of biomass at the inlet of the apparatus must be taken into account for adapting the demand of product gas to an increased or decreased generation of activated carbon in the gasification reactor. Therefore, the amount of activated carbon that is to be branched off is determined in view of the amount of biomass, from which the currently occurring activated carbon and the currently occurring hot product gas have formed.

With the aid of this process and an appropriate apparatus, respectively, that provide the process steps, it is possible to economically and simply produce a low-tar product gas during the biomass gasification. Due to the conjoined cooling of at least part of the activated carbon and the tar-loaded product gas, the tar will not, or only in insubstantial amounts, precipitate on the wall of the chamber, in which the tar-loaded hot product gas and the part of the activated carbon are cooled together. Rather, the certain amount of activated carbon adsorbs the tar from the hot product gas while cooling. An expensive cleaning to remove the tar from the chamber is thus only rarely to not at all necessary.

The temperature to which the product gas is cooled in the cooling zone is at most 50° C., for example. Cleaning becomes particularly efficient if the product gas and the certain amount of activated carbon are not cooled together below a temperature threshold that is higher than the dew point temperature of the product gas in the third process step for the adsorption process in the cooling zone. In this manner, a high loading capacity of the activated carbon remains usable. Preferably, the lower temperature threshold is a minimum of 10 Kelvin to a maximum of 20 Kelvin greater than the dew point temperature of the product gas.

The product gas that has been cleaned as a result of the adsorption process can be supplied as fuel to an apparatus, for example a gas turbine or other gas engine. Preferably, the mass flow of biomass is adapted proportionally to the performance requirements of the apparatus to be supplied with the cleaned product gas. The mass flow of the certain activated carbon conveyed from the gasification zone to the cooling zone, said activated carbon resulting from the proportionally increased or decreased amount of biomass, is preferably proportionally adapted accordingly.

Furthermore, it is of advantage if the gasification is performed at a pressure that is elevated relative to the ambient pressure—for example, at a pressure in a range of approximately 5 Bar. The generated cooled product gas can then be used—without intermediate compression—in gas turbines or pressurized engines. In order to accomplish this, the at least one reaction chamber can be pressurized accordingly. For example, the oxygen-containing gas (for example air) can be introduced under pressure via a compressor or another suitable compaction unit into the at least one reaction chamber. By performing the process at elevated pressure, it is further possible to increase the loading capacity of the activated carbon.

Preferably, the gasification of the biomass is performed as a staggered process. For example, an at least two-step process is obtained when heating is used for drying and pyrolysis, on the one hand, and the processing of the resultant pyrolysis gas and the carbonaceous residue is performed by means of oxidation and/or gasification, on the other hand, in separate chambers. It is particularly preferred, for example, if the heating zone for drying and/or pyrolysis, on the one hand, and the oxidation zone, on the other hand, are arranged in separate chambers. If heating the biomass and/or liberation of volatile constituents from the biomass for the generation of pyrolysis gas, on the one hand, and the substoichiometric oxidation, on the other hand, are performed in a staggered process in zones that are separated from each other, the desired temperature in the oxidation zone can be achieved and adjusted largely independent of the piece size of the biomass and the humidity of the biomass. A three-step process is attained if, in addition, the substoichiometric oxidation, on the one hand, and the gasification of the carbonaceous residue, on the other hand, are performed in separate zones in chambers that are separate from each other.

It is preferred when the temperature in the oxidation zone is lower than the ash softening point or the ash melting point of the ash of the carbonaceous residue. In so doing, it is advantageous if the temperature of the oxidation zone is as close as possible to the ash softening point or the ash melting point. For example, the substoichiometric oxidation is performed at a minimum temperature of 1000° C.

In a few exemplary embodiments, the heating value of the product gas is between 1.5 and 2 kWh per cubic meter. The cold gas efficiency of the process can be more than 80%.

With this process, it is possible to gasify all types and sizes of biogenic residues as biomass. The formation of a fluidized bed is not necessary. No polluted waste water is formed. The tar removal from the product gas is economically feasible even in small plants because neither high investment costs are required for tar removal nor does the operation involve high maintenance expenses.

The process according to the invention can operate as a mixed form of autothermal and allothermal gasification. In one exemplary embodiment, the temperature in the oxidation zone is adjusted by the amount, and preferably also by the temperature, of the supplied oxygen-containing gas. As a result of this, the gas production can be adapted to demand, without affecting the temperature in the gasification zone. The temperature in the gasification zone can be adjusted by indirect heating with a heating arrangement. Alternatively or additionally, the heat for the gasification zone is provided by heat carried in from the oxidation zone, for example by the carbonaceous residue that partially oxidized there and/or by the pyrolysis gas.

In one exemplary embodiment, an indirect heating of the gasification zone requires less than 10% of the energy content of the supplied biomass. Consequently, compared to a strictly allothermal gasification, smaller heating surfaces may be provided in the gasification zone.

The activated carbon and the hot product gas are preferably cooled by indirect cooling in the cooling zone. The cooled product gas, that may also be referred to as pure gas, may subsequently be supplied to the cooling zone of a filter and/or dust precipitation unit in order to reduce the dust contamination of the product gas. The filter may be supplied with activated carbon that was branched off as excess activated carbon upstream of the cooling zone and was thus not cooled together with the tar-loaded product gas. For fine cleaning, it is possible to use a cleaning device with interchangeable containers for the activated carbon as has been known per se.

It is preferred that any active carbon forming during the process—at least the part with the adsorbed tar from the third process step—be combusted in a reactor with air that was used during the third process step beforehand for cooling the product gas and the activated carbon. Preferably, the exhaust gas of the combustion is used for heating the heating zone. The total efficacy is increased as a result of this. The fuel for a reactor for generating heat for drying or for liberating the volatile constituents of the biomass during pyrolysis need not be supplied separately but accumulates automatically.

The gasification zone can be heated by the heat of a reactor. This may be accomplished in particular by the indirect heating of a reaction chamber containing the gasification zone or in a reaction chamber section in which the gasification zone is provided. In one exemplary embodiment, the activated carbon removed from the cooling zone after cooling can be used as fuel for the reactor.

During the combustion of the activated carbon in the reactor it may be advantageous to enlarge the surface of the activated carbon before supplying it to the burner, for example in that the activated carbon is ground or finely ground upon removal from the cooling zone. Due to one or more of said measures, it is possible to further increase the efficiency of the process and the apparatus, respectively.

Furthermore, it is advantageous to use a exhaust gas forming during the combustion in the reactor for preheating the oxygen-containing gas before it is conveyed into the oxidation zone.

The apparatus according to the invention for gasifying biomass with which one exemplary embodiment of the inventive process can be carried out comprises at least one first chamber in which the heating zone for the biomass is provided. The biomass can be dried and/or pyrolyzed in the heating zone. The apparatus may provide a heating zone with separate partial zones for drying and pyrolysis. For example, the partial zones may be arranged in first chambers of the apparatus that are separated from each other. The apparatus comprises a supply arrangement that is disposed to supply the biomass to the heating zone in order to produce pyrolysis gas and carbonaceous residue. Furthermore, the apparatus comprises at least one second chamber that provides an oxidation zone for the oxidation of the pyrolysis gas and a gasification zone for gasifying the carbonaceous residue. The apparatus may comprise second chambers that are separated from each other so that the oxidation zone and the gasification zone are provided in separate chambers. The second chamber or the second chambers with the oxidation zone and the gasification zone are preferably separated from the first chamber with the heating zone, so that the heating zone, on the one hand, and the oxidation zone, as well as the gasification zone, on the other hand, are separated from each other. The apparatus comprises a gas supply arrangement that is disposed to supply the oxidation zone with oxygen-containing gas, for example air, in such an amount that the pyrolysis gas present in the oxidation zone oxidizes substoichiometrically, as a result of which crude gas is formed. The production of the product gas can be adapted to the demand via the amount of supplied oxygen-containing gas and supplied biomass. The apparatus comprises a conveyer means that is disposed to convey the pyrolysis gas from the heating zone into the oxidation zone and crude gas from the oxidation zone into the gasification zone and that is disposed to convey the carbonaceous residue from the heating zone into the gasification zone. The conveyor means works, for example, with at least one conveyor arrangement and/or by means of the prevailing weight force. Furthermore, the apparatus comprises a heating means that is disposed to adjust the temperature in the gasification zone in such a manner that the carbonaceous residue—optionally with gas constituents of the crude gas that are conveyed into the gasification zone for this—is partially gasified, as a result of which activated carbon and hot product gas are formed. The heating means may be a heating arrangement, for example for indirect heating of the gasification zone. Alternatively or additionally, heat transfer from the oxidation zone is possible. The heat due to the exothermal substoichiometric oxidation of pyrolysis gas and, optionally, also due to the carbonaceous residue in the oxidation zone, can be introduced from the oxidation zone into the gasification zone, for example by heat radiation and/or by the hot crude gas or by the heated carbonaceous residue.

The product gas generated by gasification is still loaded with tar. The apparatus is therefore disposed to provide a certain amount—for example, a certain mass flow—of the activated carbon from the gasification zone and the product gas to the gasification zone in a cooling zone of the apparatus. For example, the apparatus is disposed to convey a certain amount of the activated carbon and the hot product gas in a conveyor means out of the gasification zone into a cooling zone. The conveyor means comprises, for example, a conveyor arrangement and/or operates by means of the prevailing weight force. The certain amount of activated carbon has a mass of a minimum of 2% up to a maximum of 10% of the supplied mass of the biomass (mwaf), with respect to the reference condition, free of water and free of ash, from which the activated carbon and the hot product gas have formed. The certain amount has a mass of 5% of the mass (mwaf) of the supplied biomass, with respect to the reference condition, free of water and free of ash, from which the activated carbon and the hot product gas have formed.

If, for example, a mass flow mBroh of biomass is supplied to the apparatus, this corresponds to a mass flow Bwaf of biomass, with respect to the reference condition, free of water and free of ash, that, as a rule, is lower than mBroh because the biomass supplied to the apparatus, as a rule, contains water and ash (mineral substances). A mass flow of activated carbon mAK is formed from the mass flow mBroh in the gasification zone in the apparatus. The apparatus is disposed to supply a certain amount of activated carbon in the form of a certain mass flow mAK2 to the cooling zone. This means, a certain amount of activated carbon is supplied to the cooling zone with a mass flow mAK2 of a minimum of 2% up to a maximum of 10% of the mass flow of biomass, with respect to the water-free and ash-free reference condition. In the event of a changed demand for pure product gas, for example in the event of a load change of the gas engine fed therewith, the apparatus is disposed to determine the amount of activated carbon to be conveyed in the cooling zone, based on the amount of biomass (waf) that is supplied to the generated activated carbon, as has also been explained in conjunction with the description of the process.

For example, the apparatus can thus be disposed for conveying only a certain amount, for example, of a certain mass flow, into the cooling zone so that the apparatus, for example by means of a process control arrangement, can control the process in such a manner that only a certain mass flow mAK2 of activated carbon will be produced within the range of a minimum of 2% mBwaf up to a maximum of 10% mBwaf in the gasification zone. Alternatively or additionally, the apparatus may comprise a branching arrangement for example, that is disposed to branch off excess activated carbon upstream of the cooling zone, so that the excess activated carbon will not be conveyed into the cooling zone.

Furthermore, the apparatus comprises a cooling arrangement that comprises a cooling chamber for the conjoined cooling of the branched-off certain amount of activated carbon and the product gas. The cooling arrangement is disposed to cool the certain amount of branched-off of activated carbon and the hot product gas in the cooling zone that is provided by the cooling chamber together in such a manner that an adsorption process takes place while cooling in the cooling zone, wherein the activated carbon is enriched with tar from the hot product gas while cooling.

Inasmuch as the certain amount of activated carbon and the hot product gas are cooled together in the cooling chamber and there is an adsorption of the tar contained in the product gas on the activated carbon during cooling, the tar will not, or only in a negligible amount, precipitate on the wall of the cooling chamber of the cooling arrangement. Consequently, the cooling chamber does not have to be cleaned in an expensive manner. In so doing, even an operation without human intervention is possible.

In one exemplary embodiment, the apparatus has a shared reaction chamber for the oxidation and the gasification. The transport of the crude gas and the carbonaceous residue from the oxidation zone into the gasification zone occurs, mostly aided by the weight force, essentially in vertical direction. At the same time, the transport of the hot product gas and the activated carbon from the gasification zone into the cooling zone may take place at least supported by the weight force. It is preferred if the oxidation zone and the gasification zone are arranged in one chamber and the cooling zone in another chamber separate from the latter chamber. In order to convey the substances between the chambers and/or within the chambers, it is possible for appropriate conveyor means such as, for example screw conveyors or the like, to be provided.

Preferably, the oxidation and gasification zones, on the one hand, and the cooling zone, on the other hand, are arranged separate from each other. Due to the arrangement of the zones in separate chambers, the apparatus is disposed for performing a staggered process.

It is preferred if the apparatus is disposed to be able to perform the gasification of the biomass at a pressure that is elevated relative to ambient pressure. For example, to do so, there are locks arranged on an inlet of the apparatus for supplying biomass, on an exhaust of the apparatus for discharging cleaned product gas and/or on an outlet of the apparatus for discharging ash, said locks being adapted such that the apparatus can be operated at a pressure that is elevated relative to the ambient pressure between inlet and outlet and exhaust, respectively.

BRIEF DESCRIPTION OF THE DRAWINGS

Advantageous embodiments of the process and the apparatus, respectively, can be inferred from the dependent patent claims, the description and the drawings. Hereinafter, preferred exemplary embodiments of the invention are explained in detail with reference to the appended drawings. They show in FIG. 1 a block diagram of an exemplary embodiment of the inventive process and the inventive apparatus, respectively, FIG. 2 a block diagram of another exemplary embodiment of the inventive process and the inventive apparatus, respectively, and FIG. 3 an exemplary embodiment of the apparatus with a separate heating chamber for drying and pyrolysis and a shared reaction chamber for an oxidation zone and a gasification zone, as well as a separate cooling zone in a separate cooling chamber.

DETAILED DESCRIPTION

Figure 1:
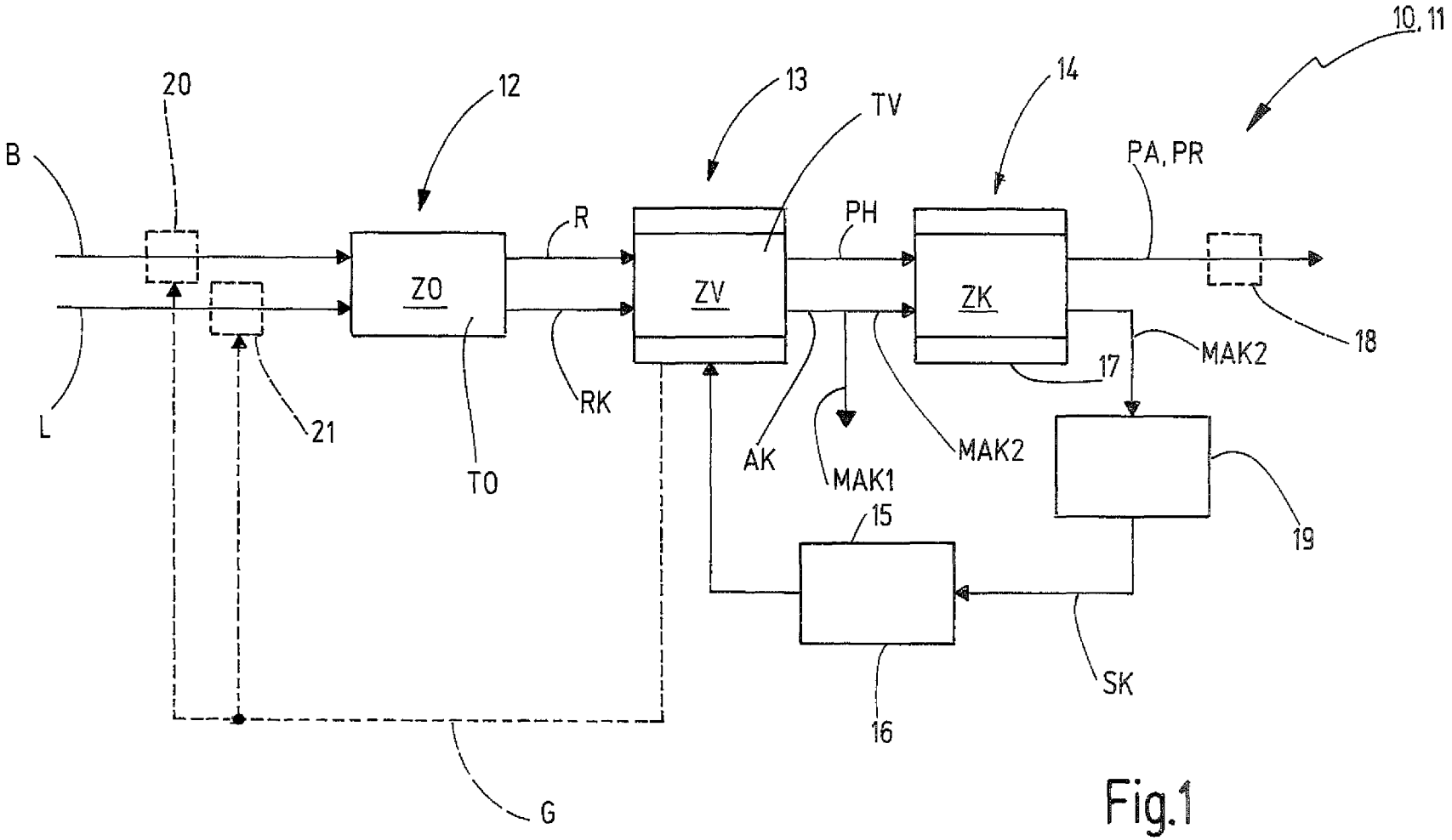

FIG. 1 depicts a schematic block diagram of an exemplary embodiment of the invention. The block diagram illustrates a process 10 and an apparatus 11, respectively, for gasifying a biomass B. The process comprises essentially three successive process steps 12, 13, 14. In a first process step 12 the biomass B is supplied, together with an oxygen-containing gas, to the oxidation zone ZO. The oxygen-containing gas used in the exemplary embodiment is air L. The amount of supplied air L is adjusted as a function of the demand of a product gas to be generated. Furthermore, it is possible to adjust a temperature TO in the oxidation zone ZO via the amount of air L.

In this first process step 12, the biomass B oxidizes substoichiometrically in the oxidation zone ZO. In so doing, a crude gas R and a carbonaceous residue RK are formed. The temperature TO in the oxidation zone is adjusted below—but as close as possible to—the ash melting point or at the ash softening point of the ash of the carbonaceous residue RK. This avoids that the ash of the carbonaceous residue melts or softens in the oxidation zone ZO and that an agglutination in the region of the oxidation zone ZO occurs. On the other hand, due to an extremely high temperature TO in the oxidation zone ZO, a reduction of the tar content in the crude gas R is already achieved. The crude gas R and the carbonaceous residue RK are subsequently partially gasified in a second process step 13 in a gasification zone ZV. The gasification zone ZV can be indirectly heated with the aid of a heating arrangement 15. Otherwise, the temperature TV in the gasification zone ZV can be adjusted, for example, by transferring heat from the oxidation zone ZO, in particular by introducing hot carbonaceous residue RK, as well as hot crude gas R. In at least one preferred embodiment, the heating arrangement 15 may comprise at least one burner 16.

The temperature TV in the gasification zone ZV can be adjusted via the heating arrangement 15, independently of the temperature in the oxidation zone ZO. In the exemplary embodiment of the invention, the temperature TV in the gasification zone ZV is a minimum of 800° C. and a maximum of 1000° C. The carbonaceous residue RK is partially gasified in the gasification zone ZV with gas constituents of the crude gas, wherein, in the exemplary embodiment, up to approximately 75% of the carbonaceous residue RK are gasified. The gas constituents that are used for gasifying the carbonaceous residue RK are mainly water vapor and carbon dioxide.

Under these conditions, a hot product gas PH that still contains an undesirably high proportion of tar, as well as activated carbon AK, are formed. The hot product gas PH and a certain amount of activated carbon MAK2 are subsequently conveyed to the cooling zone ZK in order to cool the product gas PH and the certain amount of activated carbon MAK1 together, so that the tar is transferred from the hot product gas PH to the certain amount of activated carbon MAK2 during the conjoined cooling. In this manner, a precipitation of the tar on the wall of the chamber that provides the cooling zone ZK is prevented, because the certain amount of activated carbon MAK2 adsorbs the tar. On the other hand, the activated carbon AK is utilized efficiently.

The amount of activated carbon MAK2 that is cooled together with the product gas PH is determined based on the amount of supplied biomass MB that resulted in the activated carbon AK, as well as in the product gas PH. The supplied amount of biomass MB contains, as a rule, water and ash and contains a mass mBroh. This corresponds to a mass mBaf with a reference condition, free of water and free of ash (waf). The amount of activated carbon MAK2 that is supplied to the cooling zone contains a mass mAK2 that is a minimum of 2% up to a maximum of 10% of the mass mWAF of the supplied biomass B, with respect to a water-free and ash-free reference condition of the supplied biomass B.

During a third process step 14 the hot product gas PH and the certain amount of activated carbon MAK2 and the ash forming in the gasifier are indirectly cooled with the aid of a cooling arrangement 17. In so doing, an adsorption process takes place in the cooling zone ZK, wherein the tar from the product gas PH bonds with the certain amount of activated carbon MAK2 during conjoined cooling. The amount of activated carbon MAK2 is enriched with tar from the product gas PH while cooling in a shared chamber.

The hot product gas PH can be cooled within the cooling zone ZK, for example to a temperature of below 50°. The product gas PH and the certain amount of activated carbon MAK2 are preferably cooled together not below a lower temperature threshold in the third process step for the adsorption process, said temperature threshold being higher than the dew point temperature of the product gas PH. In this manner, it is possible to derive great use from the loading capacity of the activated carbon. By enriching the activated carbon MAK2 with the tar from the product gas PH, it is possible at the end of the cooling zone ZK for a cooled product gas PA to form, which product gas can also be referred to as pure gas PR. The pure gas PR is completely free of tar and only contains a negligible percentage of tar. The pure gas PR can be used for energy generation and, in particular, does not require any additional expensive post-treatment for tar removal. In particular, the pure gas PR can be used directly in cogeneration plants.

Next to the certain amount of activated carbon MAK2 for conjoined cooling, there remains potentially an excess amount of activated carbon MAK1 from the gasification zone ZV. As indicated by arrow P in FIG. 1, this can be branched off or removed upstream of the cooling zone ZK. The excess partial amount MAK1 having a mass flow mAK1 can be supplied—for further fine cleaning of the pure gas PR—to a cleaning container arrangement to reduce the residual tar content of the pure gas PR after the conjoined cooling. Such a cleaning container arrangement for the cleaning of gas has been known per se, so that a detailed description thereof may be omitted.

As shown in dashed lines in FIG. 1, the cooled product gas PA or the pure gas PR can be freed of dust in a suitable dust precipitation unit 18, for example with the use of filters, electrostatic arrangements, cyclones or the like.

The amount of activated carbon MAK2 can be removed from the cooling zone ZK and ground or finely ground with the use of a grinding arrangement 19. The ground activated carbon, hereinafter referred to as coal dust SK, can be used as an energy carrier for combustion. For example, the carbon dust SK or at least a part thereof can be conveyed to the burner of the heating arrangement 15 for the indirect heating of the gasification zone ZV.

Furthermore, FIG. 1 shows two options for using a exhaust gas G of the at least one burner 16 of the heating arrangement. The exhaust gas G can be used, on the one hand, in a drying arrangement 20 for drying the biomass B before it is conveyed into the oxidation zone ZO. Alternatively or additionally, the exhaust gas G can be used in a preheating arrangement 21 for preheating the air L or the oxygen-containing gas before being conveyed into the oxidation zone ZO.

The process can be performed as a mixed form of an autothermal and allothermal gasification. For the optional indirect heating of the gasification zone ZV in the second process step 13, at most 10% of the energy content of the biomass are needed according to one example. The pure gas PR has a heating value between 1.5 and 2 kWh/cubic meter. Cold efficacy degrees of above 80% can be achieved. The removal of tar from the product gas Ph due to adsorption with the simultaneous cooling of the product gas PH and the certain amount of activated carbon MAK2 in the third process step 14 is extremely economical and requires neither high investment costs nor high maintenance costs.

Figure 2:
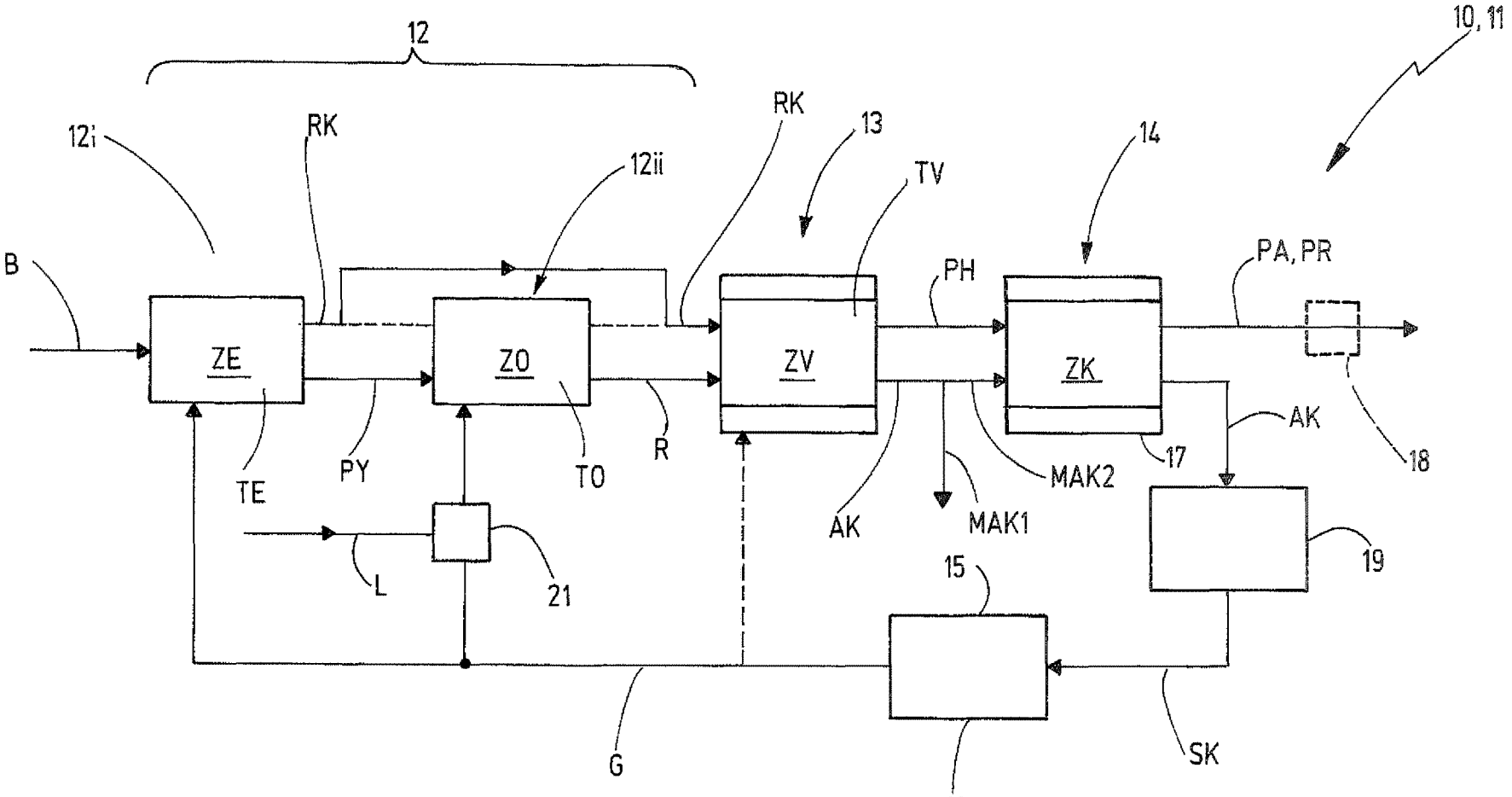

FIG. 2 shows another exemplary embodiment of the inventive process and the inventive apparatus, respectively. Hereinafter, the differences with respect to the exemplary embodiment in FIG. 1 will be described. Other than that, the description relating to the exemplary embodiment according to FIG. 1 applies.

In FIG. 2, the first process step 12 in the exemplary embodiment is divided into a heating step 12*i* and an oxidation step 12*ii*. During the heating step 12*i*, the biomass B is supplied to a heating zone ZE. In the heating zone ZE, the biomass B is dried and heated in such a manner that the volatile constituents escape from the biomass B. In so doing, a gas is formed of the volatile constituents PY (pyrolysis gas) and a carbonaceous residue RK. As illustrated, the heating zone ZE can be heated with the exhaust gas G of the burner 16 of the heating arrangement 15. Alternatively or additionally, but not illustrated, the heating zone ZE may be heated with exhaust gas of a gas engine that is supplied with the pure gas PR from the process. The temperature TE in the heating zone is, for example, approximately 500° C. The pyrolysis gas PY is conveyed to the oxidation zone ZO. Furthermore, the oxidation zone ZO is supplied with an oxygen-containing gas, for example air L, in an amount that the pyrolysis gas PY oxidizes substoichiometrically in the oxidation zone ZO. The air L can be preheated in a preheating arrangement 21 that is supplied with heat of the exhaust gas of the burner 16.

The carbonaceous residue RK can be supplied to the oxidation zone ZO together with the pyrolysis gas PY and/or, by bypassing the oxidation zone ZO, directly to the gasification zone ZV. A part of the carbonaceous residue RK is able to oxidize stoichiometrically in the oxidation zone ZO.

The exhaust gas of the burner 16 of the heating arrangement 15 can optionally be used for heating the gasification zone ZV.

Due to a spatial separation of heating for drying and pyrolysis, on the one hand, and oxidation, on the other had, the process is performed stepwise. The desired temperature TO in the oxidation zone ZO can thus be attained and adjusted largely independently of the piece size of the biomass B as well as of the humidity of the biomass.

Figure 3:
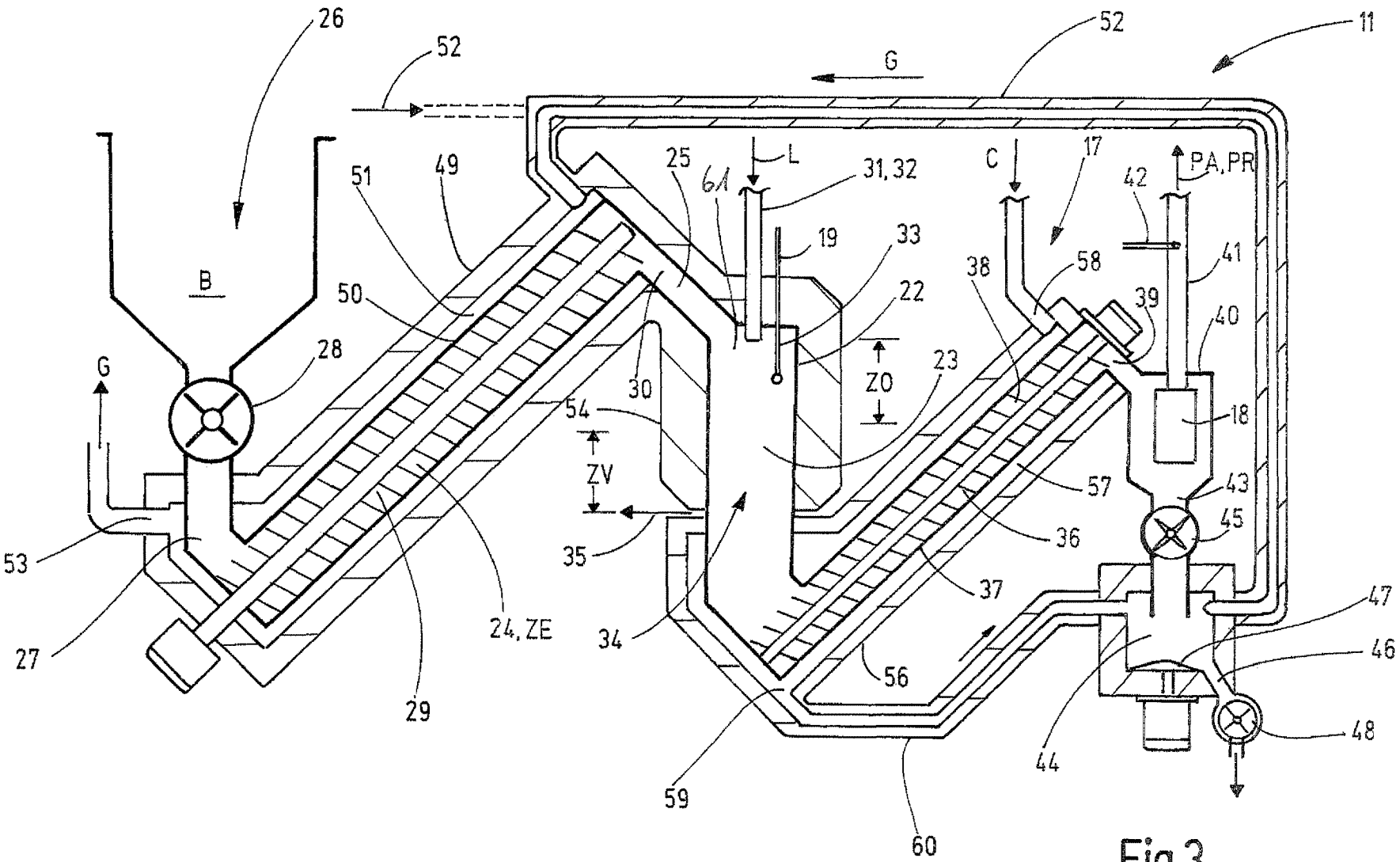

FIG. 3 shows schematically, partially in section, a side elevation of an exemplary embodiment of an apparatus 11 for gasifying biomass B. The apparatus 11 comprises an essentially vertically arranged, for example cylindrical, reaction container 22 that delimits a shared reaction chamber 23. In an upper section of the reaction chamber 23 or the reaction container 22, the oxidation zone ZO and the gasification zone ZV in an adjoining section are formed. Due to the vertical arrangement, a simplified transport within the reaction chamber 23 can be achieved, without expensive conveyor arrangements. As an alternative thereto, the at least one reaction chamber 23 can be oriented horizontally or inclined relative to the vertical and the horizontal.

Alternatively, the oxidation zone ZO and the gasification zone ZV may also be formed in reaction chambers that are separate from one another (not shown in FIG. 3). The separated reaction chambers may be arranged in reaction chambers that are separated from each other.

Carbonaceous residue RK, as well as pyrolysis gas PY, can be supplied at the vertically upper end of the reaction container 22 to the reaction chamber 23. The carbonaceous residue RK and the pyrolysis gas PY can be generated in a heating chamber 24 of the apparatus 11, separate from the reaction chamber 23, said heating chamber providing a heating zone ZE in the heating chamber 24 for drying and for the pyrolysis of the biomass B. The heating chamber is connected to the reaction chamber 23 via a line 25 for pyrolysis gas PY and carbonaceous residue RK.

The heating chamber 24 is supplied with biomass B from a silo 26 or an intermediate container. To do so, the silo 26 or the intermediate container is connected to the inlet 27 of the heating chamber 24. Between the silo 26 and the heating chamber 24 for drying and pyrolysis, there is arranged a first lock 28. For example, with the use of this first lock 28, it is possible to adjust the mass flow mBroh of biomass B that is supplied to the heating chamber 24. In the heating chamber 24 that is oriented diagonally with respect to the vertical or horizontal, there is arranged a conveyor arrangement 29, for example a screw conveyor, to convey the biomass B from the inlet 27 of the heating chamber 24 through the heating chamber 24. On the outlet 30 of the heating chamber 24, said heating chamber is connected to the reaction chamber 24 via the line 25, said reaction chamber providing the oxidation zone ZO and the gasification zone ZV. The heating chamber ZE and the reaction chamber 23 are chambers that are separated from each other so that the temperatures in the reaction chamber 23 and the heating chamber 24 can be adjusted largely independently of each other. Furthermore, in the upper section of the reaction container 22, there is a gas supply arrangement 31 for supplying the oxygen-containing gas or the air L to the oxidation zone ZO. For example, the air is conveyed, by means of a line 32, of the gas supply arrangement 31, directly into the oxidation zone ZO. In the reaction chamber 23, there is provided a temperature sensor 33 for the detection of the temperature TO in the oxidation zone ZO. For temperature regulation, the detected temperature is transmitted to a not specifically illustrated process control arrangement. Likewise, not specifically illustrated temperature sensors may be arranged in the heating zone ZE, as well as in the gasification zone ZV, these being able to detect the temperature in the heating zone ZE and in the gasification zone ZV, respectively, and to deliver them to the process control arrangement.

On the end 34 of the reaction chamber 23—viewed in conveying direction—there may be arranged a branch arrangement 35 indicated by the arrow in FIG. 3, said branch arrangement being disposed to branch off—upstream of the cooling zone ZK—excess activated carbon AK that is not to be used for the conjoined cooling of the activated carbon AK and the product gas PH in the cooling zone ZK. At the end 34 of the reaction chamber 23, said reaction chamber is connected to a cooling chamber 36 that is contained in a cooling chamber container 37. The cooling chamber 36 provides a cooling zone ZK. The cooling chamber 36 is also arranged diagonally with respect to the vertical and the horizontal. Alternatively, it may be oriented vertically or horizontally, for example. The cooling chamber 36 contains a conveyor arrangement 38, for example a screw conveyer, that is disposed to convey a certain amount, for example a certain mass flow of the activated carbon AK generated in the reaction chamber 23 through the cooling chamber 36. Furthermore, the conveyor arrangement 38 can contribute to conveying the hot product gas PH into the cooling chamber 36 or the cooling zone ZK. On the end 39 of the cooling chamber 36—viewed in conveyor direction of the activated carbon AK or the product gas PH—said cooling chamber is connected to a precipitation chamber 40 that comprises a filter 18, as well as an exhaust 41 for the pure gas PR. The filter 18 can be supplied, for example, with activated carbon AK that has been branched off upstream of the cooling zone ZK. Arranged on the exhaust 41, there is a temperature sensor 42 that detects the gas output temperature of the cleaned product gas PR and transmits it to the process control arrangement. Furthermore, the precipitation chamber 40 has on its lower end an exhaust 43 for the tar-loaded activated carbon AK. At the exhaust 43, the precipitation chamber 40 is connected to a reactor 44 for the combustion of the tar-loaded activated carbon AK. Between the precipitation chamber 40 and the reactor 44, there is a second lock 45 through which the tar-loaded activated carbon AK is conveyed into the reactor 44 for combustion of the tar-loaded activated carbon. Furthermore, in one exemplary embodiment, the reactor 44 can be supplied with excess activated carbon AK that has been branched off upstream of the cooling zone ZK, in which case an appropriate feed line is not shown in FIG. 3. The second lock 45, like the first lock 28 on the inlet 27 of the heating chamber 24, is set up in such a manner that the apparatus 11 in the heating chamber 24, the reaction chamber 23 of the reaction chamber 36, as well as the precipitation chamber 40 can be operated at a pressure that is elevated with respect to ambient pressure, for example at 5 Bar.

The reactor 44 for the combustion of the tar-loaded activated carbon AK has an exhaust 46 for the ash, in which case the ash can be conveyed to the outlet, for example, by means of a turntable 47. At the exhaust 46, the reactor 44 comprises a third lock 48 that, like the other locks 28, 45, is set up in such a manner that the apparatus 11 can be operated at a pressure that is elevated with respect to ambient pressure.

The heating chamber 24 that provides the heating zone ZE, is enclosed by an insulating jacket 49. A heating space 51 is formed between the insulating jacket 49 and the outside wall of the container 50 for the heating chamber 24. In the exemplary embodiment, the heating space 51 is connected to the reactor 44 for combustion of the tar-loaded activated carbon via a line 52, via which the heating space 51 can be supplied with exhaust gas G of the reactor 44. Alternatively or additionally, the heating space 51, as indicated by arrow 52, can be heated with the exhaust gases from a gas engine (not illustrated) for generating electricity, said gas engine being supplied with the cleaned product gas PA, PR that is used as fuel. The exhaust gas G can be discharged from the heating space 51 via an outlet 53 in the insulating jacket 49.

The reaction chamber is also enclosed by an insulating jacket 54 that encloses the oxidation zone ZO, as well as the gasification zone ZV. Between the insulating jacket 54 and the reaction chamber 23, there may be arranged a heating space for the indirect heating of the gasification zone ZV and/or the oxidation zone ZO (not illustrated) that can also be supplied with the exhaust gas G of the reactor 44.

The cooling chamber container 37 is enclosed by a jacket 56, in which case a cooling space 57 is formed between the jacket 56 and the cooling chamber container 37, wherein said cooling space can be supplied via an inlet 58 with a coolant C, said coolant being air in the exemplary embodiment. The cooling space 57 has an exhaust 59 for discharging the air C from the cooling space 57. The air C that has been heated by indirectly cooling the cooling chamber 36 can be supplied—via the line 60 arranged between the exhaust 59 and the reactor 44—to the reactor 44 for the combustion of activated carbon AK.

The exhaust 41 for discharging the cleaning gas PR can be connected, for example, to a gas engine (not illustrated) that is to be operated with the pure gas PR. For example, for the generation of the pure gas PR, the apparatus 11 operates as follows:

In stationary condition when the gas engine is to deliver constant mechanical power, the continuous generation of pure gas PR is demanded, as a rule, by the apparatus 11 and by the process 10, respectively. In order to generate the pure gas PR, as a rule, a constant mass flow of biomass mBroh (reference condition, crude) from the silo 26 for the biomass B is supplied with the aid of the first lock 28 and, for example, the force of gravity, as well as the conveyor device 29, to the heating chamber 24 for drying and pyrolysis of the biomass B. The biomass flow mBroh corresponds to a biomass flow mBwaf (condition, water-free and ash-free). In the heating chamber 24 and the heating zone ZE, respectively, the biomass B is dried and heated by indirect heating of the heating zone ZE with the exhaust gas G of the reactor 44 and/or the gas engine at, for example approximately 500° C., and heated in such a manner that the volatile constituents escape from the biomass B (pyrolysis). In so doing, carbonaceous residue RK, as well as the pyrolysis gas PY that may have a tar content of several grams per cubic meter, are formed.

The carbonaceous residue RK, as well as the pyrolysis gas PY, are conveyed into the oxidation zone ZO with the aid of the conveyor arrangement 29. In said oxidation zone, the pyrolysis gas PY is substoichiometrically oxidized with the introduction of an oxygen-containing gas, for example air L, at a temperature of approximately 1000° C. to 1200° C., in which case a crude gas R is formed. The largest part of the tar constituents in the pyrolysis gas PY are cracked. The air of the oxygen-containing gas L is controlled for the adjustment of the temperature TO in the oxidation zone ZO. For example, 1 cubic meter of air is needed per kilogram of biomass (waf). Due to preheating, the amount of air can even be reduced and the heating value of the pure gas PR can be increased. In the oxidation zone ZO and the oxidation step 12*ii*, respectively, the proportion of tar in the crude gas R is clearly decreased below 500 mg per cubic meter.

The gas transport of the crude gas R into the gasification zone ZV located below the oxidation zone ZO is achieved, for example, in that the oxygen-containing gas L is supplied on the vertically upper end 61 of the reaction chamber 23, and thus the gas L pushes the gases present in the reaction chamber 23 vertically downward. Alternatively or additionally, a not illustrated evacuation device for the product gas PH can be connected on the end 34 of the reaction chamber 23 of the apparatus 11 in order to initiate or promote the gas transport within the reaction chamber 23.

In the gasification zone ZV that may also be referred to as the reduction zone, the predominant part of the carbonaceous residue RK is gasified endothermally, in which case the gas temperature decreases accordingly to 700° C., for example. In so doing, the proportion of carbonaceous residue RK can decrease from originally 20% after pyrolysis to, for example, 5% with respect to the supplied biomass mBwaf (reference condition, water-free and ash-free). Carbon AK having a highly porous structure (activated carbon) is formed.

The process control arrangement of the apparatus 11 is disposed to convey—by control of the process parameters such as, for example the temperature and, optionally, also the pressure, and/or by means of the branch arrangement, and/or the conveyor arrangement 38 of the cooling chamber 36—a certain mass of activated carbon MAK2 out of a region from a minimum of 0.02 kilograms up to a maximum of 0.1 kilogram per kilogram of supplied biomass (with respect to the reference sate, water-free and ash-free), from which the activated carbon AK was generated, from the gasification zone ZV into the cooling zone ZK of the cooling chamber 36 and to indirectly cool said mass flow there, together with the tar-loaded product gas PH that has been produced during the gasification of the supplied biomass B, to near the temperature of the ambient temperature. During the conjoined cooling, the product gas PH is freed of the tar due to the adsorption process and subsequently conveyed as pure gas PR to the gas engine.

If the demand for pure gas PR is changed or if the heating value of the currently provided biomass B is greatly changed, the mass flow mBroh of the supplied biomass B is changed accordingly. With a time delay, a changed mass flow of activated carbon mAK is generated in the gasification zone. The process control arrangement is disposed to take into account that the change of the mass flow mAK of generated activated carbon AK occurs with a delay relative to the change of the mass flow of supplied biomass material mBroh. Therefore, even if there is a changing demand for pure gas PR, the amount MAK2 or the mass flow mAK2 that is to be supplied to the cooling zone ZK from the mass flow mAK of activated carbon that is currently present in the gasification zone ZV, is determined in view of the amount or the supplied mass flow of biomass (amount and mass flow relative to the reference condition waf), from which the activated carbon mass flow mAK was generated in the gasification zone ZV.

The tar constituents and other harmful substance from the product gas PH are adsorbed during the conjoined cooling of the activated carbon MAK2. The loading capacity (adsorption capacity) of the activated carbon AK is so high that—with a load of only 2 percent by weight per kilogram of biomass B (waf), for example 1 gram of tar constituents can be removed from the product gas PH. The product gas PH and the certain amount of activated carbon MAK2 are cooled during the conjoined cooling, preferably not below a lower temperature threshold above the dew point of the product gas PH, because the loading capacity of the activated carbon AK steeply decreases toward a relative humidity of the product gas PH of 100%. In the exemplary embodiment, indirect cooling in the cooling zone ZK is accomplished by air C, in which case the heated cooling air C is conveyed to the reactor for combustion of the tar-loaded activated carbon MAK2.

In one exemplary embodiment, the product gas PA, PR is separated, downstream of the cooling zone ZK, with a dust filter 18 from the activated carbon MAK2 that is loaded with harmful substances. The activated carbon MAK2 that is loaded with harmful substances is conveyed to the reactor 22 via the second lock 45 and combusted with the spent cooling air C. The ash is precipitated, for example via the turntable 47 and the third lock 48.

If the biomass B displays high humidity, it may be expedient to heat the heating zone ZE by indirect heating with the exhaust gases of the gas engine, as well as with exhaust gas of the reactor 44 for combustion of the tar-loaded activated carbon MAK2.

The gasification at elevated pressure with appropriate locks 28, 45, 48 at the inlet and outlet of the gasifier 11 has the advantage that the cleaned product gas PR can be supplied to the pressurized gas engine without compressor. Furthermore, as a result of this, the loading capacity of activated carbon AK can be increased.

With the inventive process 10 and the inventive apparatus 11 for fine cleaning, it is possible to generate an engine-compatible product gas PR, without requiring a subsequent cleaning (for example by wet scrubber, electrofilter or the like). The cold gas efficacy of the gasifier is above 80%, even in the event of a high-humidity biomass.

The invention relates to a process 10 for gasification of biomass B and an apparatus adapted therefor 11. The process is effected in at least three process steps 12, 12*i*, 121*ii*, 13, 14. In a first process step 12 in one exemplary embodiment, biogenic residue—biomass—may be supplied to a heating zone ZE to dry the biomass B and allow the volatile constituents to escape in order to generate a pyrolysis gas PY therefrom. The pyrolysis gas PY is supplied to an oxidation zone ZO and substoichiometrically oxidized there to generate a crude gas R. The coke-like, carbonaceous residue RK generated in the heating zone ZE is—together with the crude gas R—partially gasified in a second process step 13 in a gasification zone ZV. The heating zone ZE may be heated indirectly. The gasification zone ZV may likewise be heated indirectly. The heating zone ZE and the oxidation zone ZO are preferably zones that are separate from one another in separate chambers 23, 24. The gasification forms activated carbon AK and a hot process gas PH. The process according to the invention 10 is disposed for, or the apparatus 11 is adapted for, cooling a certain amount of the activated carbon of not less than 0.02 kg to not more than 0.1 kg per kilogram of supplied biomass (water-free and ash-free, waf) from which the activated carbon is formed in the gasification zone ZV and also the hot product gas PH in a third process step 14 in a cooling zone, for example to not more than 50° C. It is preferable when the apparatus is adapted in such a manner or the process comprises conjoined cooling of the activated carbon AK and the hot process gas PH such that the temperature of the process gas PH in the cooling zone ZK during conjoined cooling with the activated carbon AK remains above a lower threshold temperature which is higher than the dew point temperature of the product gas PH. The adsorption process taking place during the conjoined cooling of the activated carbon AK and the product gas PH has the result that, during cooling, the tar from the hot process gas PH is absorbed on the activated carbon AK in the cooling zone. Consequently, after the third process step 14, a pure gas PR, PA which is substantially tar-free is obtained. The tar-enriched activated carbon AK may be at least partly burned for heating the heating zone ZE and/or the gasification zone ZV.

List of Reference Signs

| | |
|---|---|
| 10 | Process |
| 11 | Apparatus |
| 12 | First process step |
| 12i | Heating step |
| 12ii | Oxidation step |
| 13 | Second process step |
| 14 | Third process step |
| 15 | Heating arrangement |
| 16 | Burner |
| 17 | Cooling arrangement |
| 18 | Dust precipitation unit |
| 19 | Grinding arrangement |
| 20 | Drying arrangement |
| 21 | Preheating arrangement |
| 22 | Reaction container |
| 23 | Reaction chamber |
| 24 | Heating chamber |
| 25 | Line |
| 26 | Silo |
| 27 | Inlet |
| 28 | First lock |
| 29 | Conveyor arrangement |
| 30 | Outlet |
| 31 | Gas supply arrangement |
| 32 | Line |
| 33 | Temperature sensor |
| 34 | End |
| 35 | Branch arrangement |
| 37 | Cooling chamber container |
| 38 | Conveyor arrangement |
| 39 | End |
| 40 | Precipitation chamber |
| 41 | Exhaust |
| 42 | Temperature sensor |
| 43 | Exhaust |

-continued

| List of Reference Signs | |
|---|---|
| 44 | Reactor |
| 45 | Second lock |
| 46 | Exhaust |
| 47 | Turntable |
| 48 | Third lock |
| 49 | Insulating jacket |
| 50 | Container for the heating chamber |
| 51 | Heating space |
| 52 | Arrow |
| 53 | Exhaust |
| 54 | Insulating jacket |
| 56 | Jacket |
| 57 | Cooling space |
| 58 | Inlet |
| 59 | Exhaust |
| 60 | Line |
| 61 | Upper end |
| B | Biomass |
| L | Air |
| R | Crude gas |
| RK | Carbonaceous residue |
| PH | Product gas |
| AK | Activated carbon |
| PA, PR | Cooled product gas, pure gas |
| SK | Coal dust |
| G | Exhaust gas |
| PY | Pyrolysis gas |
| MB | Amount of supplied biomass |
| MAK2 | Certain amount of activated carbon |
| MAK1 | Excess amount of activated carbon |
| mBroh | Mass, mass flow of biomass (reference condition, crude) |
| mBwaf | Mass, mass flow of biomass (reference condition, water-free and ash-free |
| mAK | Mass, mass flow of activated carbon forming in the gasification zone |
| mAK2 | Mass, mass flow of activated carbon for conjoined cooling |
| mAK1 | Mass, mass flow of excess activated carbon |
| ZO | Oxidation zone |
| TO | Oxidation zone temperature |
| ZV | Gasification zone |
| TV | Gasification zone temperature |
| ZK | Cooling zone |
| ZE | Heating zone |
| TE | Heating zone temperature |
| P | Arrow |

The invention claimed is:

1. A process (10) for gasifying biomass (B), comprising:

supplying biomass (B) to an apparatus (11) for gasification, generating a crude gas (R) and a carbonaceous residue (RK) from the supplied biomass (B) in a first process step, partially gasifying the carbonaceous residue (RK) with gas constituents of the crude gas (R) in a gasification zone (ZV) in a second process step, as a result of which activated carbon (AK) and a hot product gas (PH) are formed, removing between a minimum of 0.02 units of mass and a maximum of 0.1 units of mass of the activated carbon (AK) and the hot product gas (PH) from the gasification zone (ZV) per unit of mass of supplied biomass (B) with respect to a reference condition water-free and ash-free (waf), conveying the activated carbon (AK) and the hot product gas (PH) to a cooling zone (ZK), and conjointly cooling the activated carbon (AK) and the hot product gas (PH) in the cooling zone (ZK) in a third process step (14), so that an adsorption process takes place, wherein the activated carbon (MAK2) is enriched with tar from the hot product gas (PH) while cooling, supplying the product gas (PA, PR) that has been cleaned due to the adsorption process as fuel to an apparatus, and proportionally adapting an amount of the supplied biomass (MB) and an amount of the activated carbon (AK) removed from the gasification zone (MAK2) to performance requirements of the apparatus.

2. The process according to claim 1, wherein, in the third process step (14) for the adsorption process in the cooling zone (ZK), the product gas (PH) and the activated carbon (MAK2) are cooled together in the cooling zone (ZK) such that a temperature of the product gas remains above a lower threshold temperature that is higher than a dew point temperature of the product gas (PA, PR).

3. The process according to claim 2, wherein the lower threshold temperature is between a minimum of 10 K and a maximum of 20 K greater than the dew point temperature of the product gas (PA, PR).

4. The process according to claim 1, further comprising, during the first process step, drying the supplied biomass (B) during a first partial step (12*i*) in a heating zone (ZE) and heating the supplied biomass (B) in such a manner that volatile constituents of the biomass (B) escape, forming a pyrolysis gas (PY) and the carbonaceous residue (RK), and substoichiometrically oxidizing at least the pyrolysis gas (PY) during a subsequent partial step (12*ii*) of the first process step (12) in an oxidation zone (ZO) due to the supply of an oxygen-containing gas (L), thereby forming the crude gas (R).

5. The process according to claim 4, wherein the heating zone (ZE) and the oxidation zone (ZO) are separate from one another.

6. The process according to claim 4, further comprising substoichiometrically oxidizing of the pyrolysis gas (PY) and gasifying the carbonaceous residue (RK) in zones that are separate from one another.

7. The process according to claim 4, wherein the substoichiometric oxidation is performed in the oxidation zone (ZO) at a temperature (TO) of a minimum of 1000° C. up to a maximum of 1200° C.

8. The process according to claim 4, further comprising adjusting the temperature (TO) in the oxidation zone (ZO) by adjusting the amount of the supplied oxygen-containing gas (L).

9. The process according to claim 1, further comprising elevating a pressure at which at least one of the first, second, and third process steps are performed relative to ambient pressure.

10. The process according to claim 1, further comprising one or both of heating the crude gas (R) and the carbonaceous residue (RK) in the gasification zone (ZV) by indirect heating, and cooling the activated carbon (AK) and the hot product gas (PH) in the cooling zone (ZK) by indirect cooling.

11. The process according to claim 1, further comprising incinerating the activated carbon (AK) with adsorbed tar from the third process step (14) in a reactor (44) with air that was used in the third process step (14) for cooling the product gas (PH) and the activated carbon (AK), and heating the heating zone (ZE) using exhaust gas (G) from the incineration of the activated carbon (AK).

* * * * *